US012522908B2

(12) United States Patent
Boissonnet et al.

(10) Patent No.: US 12,522,908 B2
(45) Date of Patent: Jan. 13, 2026

(54) METHOD OF MAKING 6XXX ALUMINIUM SHEETS WITH HIGH SURFACE QUALITY

(71) Applicant: CONSTELLIUM NEUF-BRISACH, Biesheim (FR)

(72) Inventors: Laurent Boissonnet, Voiron (FR); Jean-Philippe Masse, Grenoble (FR); Gilles Guiglionda, Seyssinet-Pariset (FR)

(73) Assignee: CONSTELLIUM NEUF-BRISACH, Biesheim (FR)

( * ) Notice: Subject to any disclaimer, the term of this patent is extended or adjusted under 35 U.S.C. 154(b) by 1456 days.

(21) Appl. No.: 16/962,036

(22) PCT Filed: Jan. 15, 2019

(86) PCT No.: PCT/EP2019/050978
§ 371 (c)(1),
(2) Date: Jul. 14, 2020

(87) PCT Pub. No.: WO2019/141693
PCT Pub. Date: Jul. 25, 2019

(65) Prior Publication Data

US 2020/0340091 A1 Oct. 29, 2020

(30) Foreign Application Priority Data

Jan. 16, 2018 (FR) ..... 1850349

(51) Int. Cl.

| | |
|---|---|
| ***C22F 1/05*** | (2006.01) |
| ***B21B 3/00*** | (2006.01) |
| ***C22C 21/02*** | (2006.01) |
| ***C22F 1/00*** | (2006.01) |
| ***C22F 1/043*** | (2006.01) |

(52) U.S. Cl.
CPC ..... *C22F 1/05* (2013.01); *B21B 3/00* (2013.01); *C22C 21/02* (2013.01); *C22F 1/002* (2013.01); *C22F 1/043* (2013.01); *B21B 2003/001* (2013.01)

(58) Field of Classification Search
None
See application file for complete search history.

(56) References Cited

U.S. PATENT DOCUMENTS 5,944,923 A * 8/1999 Hayashi ..... C09D 175/04 420/544
6,652,678 B1 11/2003 Marshall et al.
2008/0178973 A1 7/2008 Uchida et al.
2011/0017370 A1 1/2011 Takaki et al.
2015/0224556 A1 8/2015 Brinkman et al.
2015/0354044 A1 12/2015 Shishido et al.
2016/0047021 A1* 2/2016 Nakamura ..... C22C 21/08 420/544
2016/0201158 A1 7/2016 Kamat et al.
2017/0349979 A1* 12/2017 Ozawa ..... C22F 1/05
2019/0119800 A1* 4/2019 Yamamoto ..... C22C 21/18

FOREIGN PATENT DOCUMENTS

| | | | |
|---|---|---|---|
| EP | 0786535 | A1 | 7/1997 |
| EP | 1375691 | A1 | 1/2004 |
| JP | 2003226926 | A | 8/2003 |
| JP | 200410982 | A | 1/2004 |
| JP | 3590685 | B2 | 11/2004 |
| JP | 2005171295 | A | 6/2005 |
| JP | 2006241548 | A | 9/2006 |
| JP | 2008045192 | A | 2/2008 |
| JP | 2009173973 | A | 8/2009 |
| JP | 2009263781 | A | 11/2009 |
| JP | 2010242215 | A | 10/2010 |
| JP | 201277318 | A | 4/2012 |
| JP | 201277319 | A | 4/2012 |
| JP | 2012214846 | A | 11/2012 |
| JP | 2015067857 | A | 4/2015 |

(Continued)

OTHER PUBLICATIONS

Guillotin, A., et al., "Quantification of roping intensity on aluminium sheets by Areal Power Spectral Density analysis," Materials Characterization, (2010), vol. 61, 1119-1125.

(Continued)

*Primary Examiner* — George Wyszomierski
*Assistant Examiner* — Janell C Morillo
(74) *Attorney, Agent, or Firm* — McBee Moore & Vanik IP, LLC

(57) ABSTRACT

The invention concerns a method for producing a 6xxx series aluminium sheet comprising the steps of homogenizing an ingot made from a 6XXX series aluminium alloy; cooling the homogenized ingot with a cooling rate in a range of from 150° C./h to 2000° C./h directly to the hot rolling starting temperature; hot rolling the ingot to a hot rolling final thickness and coiling at the hot rolling final thickness with such conditions that at least 90% recrystallization is obtained while controlling the temperatures of hot rolling, in particular the relationship between the hot rolling starting temperature and the hot rolling exit temperature and/or controlling the grain size after coiling; cold rolling to obtain a cold rolled sheet. The method of the invention is particularly helpful to make sheets for the automotive industry which combine high tensile yield strength and good formability properties suitable for cold stamping operations, as well as high surface quality.

15 Claims, No Drawings

(56) References Cited

FOREIGN PATENT DOCUMENTS

| | | | | |
|---|---|---|---|---|
| JP | 6208389 | B1 | 10/2017 | |
| JP | WO2018003709 | A1 | 8/2019 | |
| NL | 1006511 | C2 | 5/1998 | |
| WO | WO-2016012691 | A1 * | 1/2016 | ..... B21B 37/74 |

OTHER PUBLICATIONS

Woznicki, A., et al., "The Effect of Homogenization Conditions on the Structure and Properties of 6082 Alloy Billets", Archives of Metallurgy and Materials, vol. 60, No. 3, pp. 1763-1771, Oct. 2015. doi: 10.1515/amm-2015-0303.

"Characterizing Roping Grade", Polytec GmbH, accessed Sep. 3, 2025.

Denninger R, et al., "Contribution to the process assurance of the use of aluminum sheet materials for vehicle bodies", Institute for Forming Technology at the University of Stuttgart (2014).

Cremer M, et al., "Analysis of surface quality of automotive sheet with the help of white-light interferometry", Aluminum, pp. 58-61 (2021).

"Aluminum alloy", Wikipedia (Dec. 23, 2017).

Rolling Aluminum: From the Mine Through the Mill, The Aluminum Association, Inc., Ch. 5: "Sheet Rolling Operations" (2007).

Totten Ge, et al., Handbook of Aluminum—vol. 1—Physical Metallurgy and Processes, Marcel Dekker, Inc., Ch. 7: "Rolling of Aluminum" (2003).

Third Party Observations of European Patent No. EP3740599B1, mailed Oct. 1, 2025.

* cited by examiner

METHOD OF MAKING 6XXX ALUMINIUM SHEETS WITH HIGH SURFACE QUALITY

CROSS-REFERENCE TO RELATED APPLICATIONS

This application is the National Stage entry of International Application No. PCT/EP2019/050978, filed 15 Jan. 2019, which claims priority to France No. 1850349, filed 16 Jan. 2018.

BACKGROUND

Field

Field of the Invention

The present invention relates to a method of making 6XXX series aluminium sheet, particularly useful for the automotive industry.

Description of Related Art

Various aluminium alloys are used in the form of sheets or blanks for automotive usages. Among these alloys, AA6xxx aluminium alloys series, such as AA6016-T4 are known to combine interesting chemical and mechanical properties such as hardness, strength, and even corrosion resistance. In addition to the requirements discussed above, another requirement is that the aluminium alloys for automotive components do not have objectionable and/or deleterious surface defects referred to as roping, or paint brush lines, which appear on the surface of stamped or formed aluminium sheet components. The roping lines appear in the rolling direction only upon application of sufficient transverse strain, such as that occurring in typical stamping or forming operations. New criteria for surface quality have recently appeared based on analysis of digitized images, including any directional surface roughening which are relevant for the final product aspect. This type of method has been for example explained by A. Guillotin et al. (MATERIALS CHARACTERIZATION 61(2010)1119-1125) or VDA (Verband Der Automobilindustrie, German Association of the Automotive Industry) Recommendation 239-400, July 2017. These properties generally make AA6xxx aluminium alloys a material of choice in the automotive industry. In order to face the constant increase of applications of these sheets and the required surface quality in the automotive industry, it is needed to improve the speed of the method of making such products for a given surface quality requested by the customers. Indeed, current method including several heat treatments have proved to be efficient for surface quality and formability but may be long and expensive.

The patent U.S. Pat. No. 6,652,678 describes a method of converting an ingot of a 6000 series aluminium alloy to self-annealing sheet, comprising subjecting the ingot to a two-stage homogenisation treatment, first at least 560° C. and then at 450° C. to 480° C., then hot rolling the homogenised ingot at a starting hot roll temperature of 450° C. to 480° C. and a finishing hot roll temperature of 320° C. to 360° C. The resulting hot rolled sheet has an unusually low Cube recrystallization component.

The patent application US2016/0201158 describes a method of producing a 6xxx series aluminium sheet, comprising: casting a 6xxx series aluminium alloy to form an ingot; homogenizing the ingot; hot rolling the ingot to produce a hot rolled intermediate product, followed by: a) after exit temperature coiling, immediately placing into an anneal furnace, or b) after exit temperature coiling, cooling to room temperature and then placing into an anneal furnace; annealing; cold rolling; and subjecting the sheet to a continuous anneal and solution heat treatment process. The application details the problems related to the self-annealing method.

The patent application EP1375691 A9 describes a method for producing a rolled sheet of a 6000 type aluminium alloy containing Si and Mg as main alloy components, which comprises subjecting an ingot to a homogenization treatment, cooling to a temperature lower than 350° C. at a cooling rate of 100° C./hr or more, optionally to room temperature, heating again to a temperature of 300 to 500° C. and subjecting it to hot rolling, cold rolling the hot rolled product, and subjecting the cold rolled sheet to a solution treatment at a temperature of 400° C. or higher, followed by quenching.

The patent application EP0786535 A1 describes a method wherein an aluminium alloy ingot containing not less than 0.4% by weight and less than 1.7% by weight of Si, not less than 0.2% by weight and less than 1.2% by weight of Mg, and Al and unavoidable impurities for the remainder is homogenized at a temperature of not lower than 500° C.; the resultant product being cooled from a temperature of not lower than 500° C. to a temperature in the range of 350-450° C. and started to be hot rolled; the hot rolling step being finished at a temperature in the range of 200-300° C.; the resultant product being subjected to cold rolling at a reduction ratio of not less than 50% immediately before it has been solution-treated; the cold rolled product being then solution-treated in which it is retained at a temperature in the range of 500-580° C. at a temperature increasing rate of not less than 2° C./s for not more than 10 minutes; the resultant product being subjected to hardening in which it is cooled to a temperature of not higher than 100° C. at a cooling rate of not less than 5° C./s.

Regarding the formability of aluminium alloy sheets, it has been indicated that it is related to the size of particles such as Al—Fe—Si, Mg—Si particles, etc., that constitute precipitates in the alloy as well as to the texture of the alloy. For example, patent applications JP 2012-77319, JP 2006-241548, JP 2004-10982, JP 2003-226926 propose methods that take into perspective the control of the size and distribution of those particles, control of the texture and the resulting r value.

On another hand, in parallel with the proposals relating to formability improvement such as described above, several initiatives aiming at improving roping resistance in relation with appearance quality after forming have also been reported. According to these, the occurrence of roping is related to the recrystallization behavior of the material. And as a measure to restrain the occurrence of roping, it has been proposed to control recrystallization at the stage of sheet production by means of the hot rolling or the like that is carried out after homogenization of the alloy ingot. As practical measures of such roping resistance improvement, the patents JP2823797 and JP3590685 restrain the crystal grain from coarsening during hot rolling by chiefly setting the starting temperature of hot rolling to a relatively low temperature of 450° C. or less, and seek to control the material structure after the subsequent cold working and solution treatment. Patent application JP2009-263781 recites implementing different circumferential speed rolling in warm areas and different circumferential speed rolling in the cold areas after hot rolling. Here, patent JP3590685, and patent applications JP2012-77318 and JP2010-242215 propose to perform intermediate annealing after hot rolling, or to perform intermediate annealing after briefly carrying out cold rolling.

The patent application JP2015-67857 describes a manufacturing method of Al—Mg—Si-based aluminium alloy sheet for automobile panel that is characterized by the following: an ingot is prepared that comprises Si: 0.4~1.5 wt. %, Mg: 0.2~1.2 wt. %, Cu: 0.001~1.0 wt. %, Zn: 0.5 wt. % or less, Ti: than 0.1 wt. %, B: 50 ppm or less, as well as one or more than two of the following Mn: 0.30 wt. % or less, Cr: 0.20 wt. % or less, Zr: 0.15% or less, balance being Al and inevitable impurities, the said ingot goes through homogenization treatment at a temperature above 450° C., it is cooled to less than 350° C. at a cooling rate of over 100° C./hour, and is once again reheated at a temperature between 380° C.~500° C., and hot rolling is conducted to initiate the rolling process, and plate with thickness of 4~20 mm is created, and the said plate goes through cold reduction so that its plate thickness reduction rate is over 20% and the plate thickness is greater than 2 mm, and goes through intermediate annealing at a temperature between 350~580° C., and goes through further cold reduction, and then after it goes through a solution treatment at a temperature range of 450~600° C., it is rapidly cooled to a temperature that is less than 150° C. at an average cooling speed of over 100° C./minute, and is heat processed within 60 minutes after the rapid cooling process so that it stays within 40~120° C. for 10 to 500 minutes.

There is thus a need in the automotive industry for an improved method, in particular with a high productivity, of making 6xxx series aluminium alloys sheets, which combine high tensile yield strength and good formability properties suitable for cold stamping operations, as well as high surface quality and high corrosion resistance.

SUMMARY OF THE INVENTION

An object of the invention is a method for producing a 6xxx series aluminium sheet comprising the steps of

- homogenizing an ingot made from a 6XXX series aluminium alloy preferably comprising 0.3-1.5 wt. % of Si, 0.1-1.2 wt. % of Mg and 0.5 wt. % or less of Cu, Mn 0.03-0.5 wt. % and/or Cr 0.01-0.4 wt. %, Fe 0.03 to 0.4 wt. %, Zn up to 0.5 wt. %, V up to 0.2 wt. %, Zr up to 0.2 wt. %, Ti up to 0.1 wt %, rest aluminium and unavoidable impurities up to 0.05 wt. % each and 0.15 wt. % total,
- cooling the homogenized ingot with a cooling rate in a range from 150° C./h to 2000° C./h directly to a hot rolling starting temperature HRST,
- hot rolling the ingot to a hot rolling final thickness and coiling at the hot rolling final thickness and at a hot rolling exit temperature with such conditions that at least 90% recrystallization is obtained, wherein said HRST is between 350° C. and 450° C. and the hot rolling exit temperature is at least 300° C. and is comprised between 1.2*HRST-135° C. and 1.2*HRST-109° C. and/or is set to obtain an average grain size in L/ST section between mid-thickness and quarter thickness according to ASTM E-112 intercept method of less than 160 μm in the longitudinal direction,
- cold rolling to obtain a cold rolled sheet.

Another object of the invention is a solution heat-treated and quenched 6xxx series aluminium sheet obtainable by a method of the invention having a surface quality quotation according to VDA Recommendation 239-400 of less than 4.8, preferably less than 4.5.

Yet another object of the invention is the use of a solution heat-treated and quenched 6xxx series aluminium sheet according to the invention in the automotive industry.

DESCRIPTION OF THE INVENTION

All aluminium alloys referred to in the following are designated using the rules and designations defined by the Aluminium Association in Registration Record Series that it publishes regularly, unless mentioned otherwise.

Metallurgical tempers referred to are designated using the European standard EN-515.

All the alloy compositions are provided in weight % (wt. %).

The inventors have found that the method of the prior art to make 6xxx aluminium alloy series can be improved without prejudice to the strength, formability properties and corrosion resistance and with improved surface quality.

According to the invention, an ingot is prepared by casting, typically Direct-Chill casting, using 6xxx series aluminium alloys. The ingot thickness is preferably at least 250 mm, or at least 350 mm and preferentially a very thick gauge ingot with a thickness of at least 400 mm, or even at least 500 mm or 600 mm in order to improve the productivity of the process. Preferably the ingot is from 1000 to 2000 mm in width and 2000 to 8000 mm in length.

The Si content is from 0.3 wt. % to 1.5 wt. %.

Si is an alloying element that forms the base of the alloy series of the present invention and, together with Mg, contributes to strength improvement. When the Si content is under 0.3 wt. % the aforementioned effect may be insufficient, while a content exceeding 1.5 wt. % may cause the occurrence of coarse Si particles and coarse Mg—Si base particles and leads to a drop in bending workability. The Si content is therefore preferably set within a range of 0.3-1.5wt. %. Minimum Si content of 0.55 wt. %, or 0.6 wt. % or 0.7 wt. % or 0.8 wt. % or 0.9 wt. % or 1.0 wt. % or 1.1 wt. % may be advantageous. Maximum Si content of 1.4 wt. %, or 1.3 wt. % or 1.2 wt. % or 1.1 wt. % may be advantageous.

Mg is also an alloying element that forms the base of the alloy series that is the target of the present invention and, together with Si and Mg, contributes to strength improvement. The Mg content is from 0.1 wt. % to 1.2 wt. %. When the Mg content is under 0.1% wt. %, the G.P. zone formation, that contributes to strength improvement, decreases due to precipitation hardening at the time of paint baking, and strength improvement may therefore be insufficient. On the other hand, a content exceeding 1.2 wt. % may cause the occurrence of coarse Mg—Si base particles and may lead to a drop in bending workability. Minimum Mg content of 0.15 wt. %, or 0.20 wt. % or 0.25 wt. % or 0.30 wt. % or 0.35 wt. % or 0.40 wt. % or 0.45 wt. % or 0.50 wt. % or 0.55 wt. % may be advantageous. Maximum Mg content of 0.90 wt. %, or 0.85 wt. % or 0.80 wt. % or 0.75 wt. % or 0.70 t. % or 0.65 wt. % or 0.60 t. % or 0.55 wt. % may be advantageous.

There are some advantageous combinations of Si and Mg contents. In one embodiment, the Si content is between 1.1 wt. % and 1.5 wt. % and preferably between 1.2 wt. % and 1.4 wt. % and the Mg content is between 0.1 wt. % and 0.5 wt. % and preferably is between 0.2 wt. % and 0.4 wt. %. In another embodiment the Si content is between 0.7 wt. % and 1.1 wt. % and preferably between 0.8 wt. % and 1.0 wt. % and the Mg content is between 0.2 wt. % and 0.6 wt. % and preferably is between 0.3 wt. % and 0.5 wt. %. In yet another embodiment the Si content is between 0.55 wt. % and 0.95 wt. % and preferably between 0.65 wt. % and 0.85 wt. % and the Mg content is between 0.45 wt. % and 0.85 wt. % and preferably is between 0.50 wt. % and 0.75 wt. %.

The process parameters of the present invention which enable a high surface quality have been defined for a Cu content of at most 0.5 wt. %, preferably at most 0.2 wt. % and preferentially at most 0.1 wt. %.

Mn and Cr are effective elements for strength improvement, crystal grain refining and structure stabilization. When the Mn content is under 0.03 wt. %, and/or the Cr content is under 0.01 wt. % respectively, the aforementioned effect is insufficient. On the other hand, a Mn content exceeding 0.5 wt. % and/or a Cr content exceeding 0.4 wt. % may not only cause a saturation of the above effect but also cause the generation of multiple intermetallic compounds that could have an adverse effect on formabilty, in particular hemming. Consequently, the Mn content is set within a range of 0.03-0.5 wt. % and/or Cr within a range 0.01-0.4 wt. % respectively. Preferentially the Mn content is set within a range of 0.04-0.3 wt. % and/or Cr within a range 0.02-0.3 wt. %, respectively Fe is also an effective element for strength improvement and crystal grain refining. A Fe content under 0.03 wt. % may not produce a sufficient effect while, on the other hand, a Fe content exceeding 0.4 wt. % may cause the generation of multiple intermetallic compounds that could make bending workability drop. Consequently, the Fe content is set within a range of 0.03 wt. % to 0.4 wt. % and preferably 0.1 wt. % to 0.3 wt. %. In an embodiment the Fe content is less than 0.2 wt. %.

Zn may be added up to 0.5 wt. % and preferably up to 0.2 wt. % without departing from the advantages of the invention. In an embodiment Zn is among the unavoidable impurities.

V may be added up to 0.2 wt. % and preferably up to 0.1 wt. % without departing from the advantages of the invention. In an embodiment V is among the unavoidable impurities.

Zr may be added up to 0.2 wt. % and preferably up to 0.1 wt. % without departing from the advantages of the invention. In an embodiment Zr is among the unavoidable impurities.

Grain refiners such as Ti, $TiB_2$ or the like are typically added with a total Ti content of up to 0.1 wt. % and preferably between 0.01 and 0.05 wt. %.

The rest is aluminium and unavoidable impurities up to 0.05 wt. % each and 0.15 wt. % total.

Particularly preferred aluminium alloy compositions suitable for the invention are AA6005, AA6022 and AA6016.

In a first preferred embodiment of the invention said 6xxx series aluminium alloy comprise in wt. %, Si: 0.55-0.95; Mg: 0.45-0.85; Cu: up to 0.1; Mn 0.03 to 0.1; Fe 0.05-0.20; Ti: up to 0.05, rest aluminium and unavoidable impurities up to 0.05 each and 0.15 total. With this first preferred embodiment, the tensile yield strength TYS in the LT direction after 2% stretching and bake hardening 20 minutes at 185° C. is advantageously higher than 225 MPa and preferably between 235 and 265 MPa. This embodiment is favourable to obtain a high strength.

In a second preferred embodiment of the invention said 6xxx series aluminium alloy comprise in wt. %, Si: 0.7-1.5; Mg: 0.1-0.8; Cu: up to 0.2; Mn: 0.03-0.3; Fe 0.03-0.4; Ti: up to 0.1, rest aluminium and unavoidable impurities up to 0.05 each and 0.15 total, and preferably Si: 0.8-1.1; Mg: 0.2 -0.6; Cu: up to 0.1; Mn 0.03-0.2; Fe 0.1-0.3; Ti: up to 0.05, rest aluminium and unavoidable impurities up to 0.05 each and 0.15 total. With this second preferred embodiment, the tensile yield strength TYS in the LT direction after 2% stretching and bake hardening 20 minutes at 185° C. is advantageously comprised between 200 and 225 MPa and preferably between 210 and 220 MPa. This embodiment is favourable to obtain a high formability.

The ingot is then homogenised typically at a temperature between 500° C. and 590° C., preferably at a temperature between 500° C. and 570° C. and more preferably between 540° C. and 560° C. typically for a period of 0.5 to 24 hours, for example during at least 2 hours and preferably during at least 4 hours. In an embodiment the homogenization is carried out at a temperature of at most 555° C. Homogenization may be carried out in one stage or several stages of increasing temperature, in order to avoid incipient melting.

After homogenization, the ingot is cooled with a cooling rate in a range from 150° C./h to 2000° C./h directly to the hot rolling starting temperature. Preferably, the cooling rate is of at least 200° C./h, preferably at least 250° C./h and preferentially at least 300° C./h. In an embodiment the cooling rate is of at most 1500° C./h, or at most 1000° C./h or at most 500° C./h. The cooling rate of the invention is preferably obtained at mid-thickness and/or at quarter thickness of the ingot and/or on average of the ingot, typically between the homogenizing temperature and the hot rolling temperature and preferably in the temperature range between 500° C. and the hot rolling temperature. A device such as the cooling facility disclosed in patent application WO2016/012691, which is enclosed by reference in its entirety, and the method described therein are suitable for cooling the ingot. When the ingot thickness is at least 250 mm or at least 350 mm and preferentially, at least 400 mm, or even at least 500 mm or 600 mm and wherein preferably the ingot is from 1000 to 2000 mm in width and 2000 to 8000 mm in length, it is advantageous that a thermal differential of less than 40° C. and preferentially of less than 30° C. over the entire ingot cooled from the homogenization temperature is obtained at the hot rolling starting temperature, when hot rolling is started. If a thermal differential of less than 40° C. or preferably less than 30° C. is not obtained, the desired hot rolling starting temperatures may not be obtained locally in the ingot and the desired surface quality and mechanical properties may not be obtained. Preferably the cooling is carried out in at least two phases: a first spraying phase in which the ingot is cooled in a chamber comprising ramps of nozzles for spraying cooling liquid or spray under pressure, divided into upper and lower parts of said chamber, so as to spray the two large top and bottom surfaces of the ingot and a complementary phase of thermal equalization in still air, in a tunnel preferably with interior reflective walls, lasting from 2 to 30 minutes depending on the ingot format and the cooling value. Preferably the phase of thermal equalization is less than 10 minutes. Preferably the small surfaces on the edges of the ingot are not cooled by directly spraying cooling liquid or spray under pressure. Preferably, the spraying and thermal equalization phases are repeated in the case of very thick ingots and for an overall average cooling of more than 80° C. Preferably the cooling liquid, including that in a spray, is water, and preferably deionized water. Preferably the head and the foot of the ingot, or typically the 300 to 600 mm at the ends, are less cooled than the rest of the ingot, so as to maintain a hot head and foot, a favourable configuration for engaging the ingot during reversible hot rolling. In an embodiment the cooling of the head and foot is modulated by turning the ramps of nozzles on or off. In another embodiment the cooling of the head and foot is modulated by the presence of screens. Preferably the spraying phases and not thermal equalization are repeated, and the head and foot of the ingot, or typically the 300 to 600 mm at the ends, are cooled differently from the rest of the ingot in at least one of the spray chambers. Preferably, the longitudinal thermal uniformity of the ingot is improved by relative movement of the ingot in relation to the spray system: the ingot passes or moves with a reciprocating movement facing a fixed spray system or vice versa. Preferably the transverse thermal uniformity of the ingot is ensured by modulating spraying in the ingot width by switching the nozzles or spray nozzles on or off, or screening said spraying. Advantageously, the ingot moves horizontally in the spray chamber and its speed is greater than, or equal to 20 mm/s. The reason why the cooling speed after homogenization is regulated in such a manner is because if the cooling speed is too low, too coarse and possibly numerous Mg—Si based particles, tend to precipitate and the product may be difficult to solutionize but if the cooling speed is too high, too fine and possibly scarce Mg—Si based particles may precipitate and the product may be difficult to recrystallize at the exit of hot rolling. In the present invention, the method for obtaining the temperature at mid-thickness and/or quarter thickness of the ingot and/or on average of the ingot may consist of using and measuring an ingot with an embedded thermoelement, or making calculation using a heat transfer model.

The cooling rate is adjusted so that the holding time at the hot rolling temperature is less than 15 mn, preferably less than 10 mn and preferentially less than 5 mn.

In the hot rolling step, the setting of the temperature for coiling after hot rolling is important. With the present invention, the aforementioned cooling after homogenization enable to obtain an appropriate particle distribution, and to perform hot rolling on an ingot with particles of controlled size that do not hinder the promoting action and grain boundary migration of recrystallization and are easy to solutionize. Here, appropriately setting the coiling temperature for the obtained hot rolled sheet produces recrystallization at the hot rolling exit, and enables to obtain a recrystallized structure that forms the base of the material structure for surface quality improvement.

Preferably the hot rolling starting temperature (HRST) is between 350° C. and 450° C. In some embodiments the hot rolling starting temperature is at least 370° C., or at least 375° C. or at least 380° C., or at least 385° C., at least 390° C., or at least 395° C., or at least 400° C., or at least 405° C. In some embodiments the hot rolling starting temperature is at most 445° C., or at most 440° C. or at most 435° C., or at most 430° C., or at most 425° C., or at most 420° C., Typically it is meant by hot rolling starting temperature the temperature at mid-length and mid-thickness of the ingot, however, because the thermal differential within the ingot is low, the hot rolling starting temperature may be measured at mid-width on the surface with a contact probe. The ingot is preferably hot rolled to a hot rolling final thickness and coiled at the hot rolling final thickness with such conditions that at least 90% recrystallization is obtained at the hot rolling final thickness. The hot rolling final thickness can also be named hot rolling exit thickness, it is the thickness obtained after hot rolling. The hot rolling final thickness is higher than the product final thickness when cold rolling is carried out after hot rolling. Preferably, the ingot is hot rolled to a hot rolling final thickness and coiled at the hot rolling final thickness with such conditions that that at least 98% recrystallization, typically about 100% recrystallization is obtained at the hot rolling final thickness. By at least 90% or 98% recrystallization it is meant, respectively, that the recrystallization rate measured at at least three locations through the width of the strip obtained after hot rolling has a minimum value of at least 90% or 98%. Typically, recrystallization varies through the thickness of the sheet.

In order to obtain recrystallization at the hot rolling final thickness the hot rolling exit temperature, also known as coiling temperature, is at least 300° C. In an embodiment the hot rolling exit temperature is at least 310° C. or at least 330° C. or at least 332° C. or at least 335° C., or at least 337° C. or at least 340° C. or at least 342° C., or at least 345° C. In an embodiment the hot rolling exit temperature is at most 380° C. The thickness reduction during the last stand of hot rolling may also affect the recrystallization rate and the final properties of the product and preferably the thickness reduction during the last stand of hot rolling is at least 25%. In an embodiment it is at least 27% or at least 30% or at least 32%. In an embodiment is at most 60%. The hot rolling final thickness is typically between 2 and 13 mm.

The present inventors have found that, surprisingly, by controlling the temperatures of hot rolling, in particular the relationship between the hot rolling starting temperature HRST and the hot rolling exit temperature, and/or by controlling the grain size after coiling, it is possible to obtain a high surface quality of the final product. In particular when the hot rolling exit temperature is comprised between 1.2*HRST-135° C. and 1.2*HRST-109° C. and/or is set to obtain an average grain size in L/ST section between mid-thickness and quarter thickness according to ASTM E-112 intercept method of less than 160 μm in the longitudinal direction, the surface quality is significantly improved. Preferably the hot rolling exit temperature is at least 1.2*HRST-123° C. and/or is at most 1.2*HRST-115° C. and/or is set to obtain an average grain size in L/ST section between mid-thickness and quarter thickness according to ASTM E-112 intercept method of less than 150 μm in the longitudinal direction. As far as surface quality is concerned, with a process of the invention, a quotation according to VDA Recommendation 239-400 of less than 4.8 advantageously less than 4.5, preferably less than 4.0 and even less than 3.8 may be obtained, preferably for a T4 temper.

Cold rolling is realized directly after the hot rolling step to further reduce the thickness of the aluminium sheets. With the method of the invention annealing and/or solution heat treatment after hot rolling or during cold rolling is not necessary to obtain sufficient strength, formability, surface quality and corrosion resistance. Preferably no annealing and/or solution heat treatment after hot rolling or during cold rolling is carried out. The sheet directly obtained after cold rolling is referred to as the cold rolled sheet. The cold rolled sheet thickness is typically between 0.5 and 2 mm.

In an embodiment, the cold rolling reduction is at least 50%, or at least 65% or at least 70% or at least 75% or at least 80%. Typically the cold rolling reduction is at about 80%.

Advantageous embodiments of cold rolling reduction may enable to obtain improved mechanical properties and/or to obtain an advantageous grain size for surface properties such as surface quality.

The cold rolled sheet is advantageous at least because it is easy to solutionize, while providing after solutionizing high surface quality and good mechanical properties.

After cold rolling, the cold rolled sheet is advantageously further solution heat treated and quenched in a continuous annealing line. Preferably the continuous annealing line is operated in such a way that the equivalent holding time at 540° C., $t_{eq}^{540°}$, is less than 45 sec, preferably less than 35 s and preferentially less than 25 s, the equivalent holding time being calculated according to the equation $$t_{eq}^{540^\circ} = \int_{time\ spent\ in\ furnace} dt \cdot \exp\left[-\frac{Q}{R}\cdot\left(\frac{1}{T^{\circ\ C}(t)+273} - \frac{1}{540+273}\right)\right]$$

with Q an activation energy of 146 kJ/mol and R=8.314 J/mol

Typically, the continuous annealing line is operated such that the heating rate of the sheet is at least 10° C./s for metal temperature above 400° C., the time above 520° C. is between 5 s and 25 s and the quenching rate is at least 10° C./s, preferably at least 15° C./s for 0.9 to 1.1 mm gauge. Preferred solution heat treatment temperatures are near solidus temperatures typically above 540° C. and below 570° C. The coiling temperature after solution heat treatment is preferably between 50° C. and 90° C. and preferentially between 60° C. and 80° C.

After solution heat treatment and quench the sheet may be aged to a T4 temper. After being aged to a T4 temper the sheet may be cut and formed to its final shape, painted and bake hardened.

The method of the invention is particularly helpful to make sheets for the automotive industry which combine high tensile yield strength and good formability properties suitable for cold stamping operations, as well as high surface quality and high corrosion resistance with a high productivity.

EXAMPLES

Example 1

In this example three ingots made of an alloy having in wt. % the following composition: Si: 0.9; Mg: 0.4; Mn 0.1; Fe 0.2; Cu 0.08; Ti 0.04; rest aluminium and unavoidable impurities up to 0.05 wt. % each and 0.15 wt. % total were cast into rolling ingots which had a thickness of 520 mm and transformed.

The ingots were homogenized at the temperature of 560° C. during 2 hours. After homogenizing, the ingots were cooled down with a cooling rate at mid-thickness of 300° C./h directly to the hot rolling starting temperature. A thermal differential of less than 30° C. over the entire ingot cooled from the homogenization temperature was obtained. When this thermal differential was reached, hot rolling was started without wait. A device as described in patent application WO2016/012691 was used to cool down the ingots after homogenizing and obtain a thermal differential of less than 30° C. over the entire ingot cooled from its homogenization temperature.

The ingots were hot rolled with the conditions disclosed in Table 1. The hot rolling mill consisted of a reversing mill and a 4 stands tandem mill, the stands being named C3 to C6, so that rolling in C6 is the last stand of hot rolling.

TABLE 1

Hot rolling parameters

| Ingot | Hot rolling starting temperature [° C.] | Hot rolling exit temperature [° C.] | reduction stand C6 [%] | 1.2*HRST-135 | 1.2*HRST-109 |
|---|---|---|---|---|---|
| 1 | 415 | 358 | 37% | 363 | 389 |
| 2 | 400 | 359 | 38% | 345 | 371 |
| 3 | 384 | 364 | 33% | 326 | 352 |

The recrystallization rate of the hot rolled strips after hot rolling was 100%.

The strips were further cold rolled to sheets with a final thickness of 1 mm. The sheets were solution heat treated, such that the equivalent holding time at 540° C. was about 30 s, and quenched in a continuous annealing line.

The surface quality was measured according to VDA Recommendation 239-400. In particular, the sheet sample were plastically pre-strained 10%, transverse to the rolling direction. The surfaces were cleaned and a replica of the pre-strained surface was created by moistening the surface with water, applying a tape, removing the air bubbles and the water located under the tape, drying the tape with a soft cloth, grinding the tape by moving a grinding tool with a constant pressure back and forth 2 times transverse to the rolling direction, removing the replica from the surface and carryover on a black background, removing the air bubbles and the water, drying the tape with a cloth. The replicas were scanned. The scan resolution was 300 dpi in "shades of grey". The evaluation and the determination of the surface quality "Roping value RK" was performed according to the instructions and Macro described in VDA Recommendation 239-400. A low RK value corresponds to a high surface quality.

The RK values are presented in Table 2

TABLE 2

RK values

| Ingot | RK |
|---|---|
| 1 | 5.1 |
| 2 | 3.5 |
| 3 | 5.4 |

The surface quality of ingot 2 according to the invention was much improved compared to ingots 1 and 3.

The 0.2% tensile yield strength, TYS, and ultimate tensile strength, UTS, of the T4 (after 6 days of natural ageing) and bake hardened sheets (2% stretching and 20 min at 185° C.) from those T4 aged sheets were determined in the transverse direction using methods known to one of ordinary skill in the art. The tensile tests were performed according to ISO/DIS 6892-1. The results are provided in Table 3.

TABLE 3

Mechanical properties

| | T4 | | |
|---|---|---|---|
| | TYS LT (MPa) | UTS LT (MPa) | Bake hardened TYS LT (MPa) |
| 1 | 92 | 207 | 201 |
| 2 | 96 | 208 | 211 |
| 3 | 102 | 214 | 224 |

Example 2

In this example six ingots, made of an alloy having in wt. % the following composition: Si: 1.3; Mg: 0.3; Mn 0.1; Fe 0.2; Cu 0.09; Ti 0.03; rest aluminium and unavoidable impurities up to 0.05 wt. % each and 0.15 wt. % total were cast into rolling ingots which had a thickness of 520 mm and transformed.

The ingots were homogenized and cooled as in example 1.

The ingots were hot rolled with the conditions disclosed in Table 4. The hot rolling mill consisted of a reversing mill and a 4 stands tandem mill, the stands being named C3 to C6, so that rolling in C6 is the last stand of hot rolling.

TABLE 4

| Hot rolling parameters | | | | | | |
|---|---|---|---|---|---|---|
| Ingot | Hot rolling starting temperature [° C.] | Hot rolling exit temperature [° C.] | reduction stand C6 [%] | 1.2*HRST −135 | 1.2*HRST −109 | Grain size after hot rolling (μm) |
| 4 | 414 | 375 | 34 | 362 | 388 | 146 |
| 5 | 397 | 352 | 35 | 341 | 367 | |
| 6 | 402 | 364 | 37 | 347 | 373 | 130 |
| 7 | 386 | 344 | 35 | 328 | 354 | 128 |
| 8 | 430 | 345 | 36 | 381 | 407 | 182 |
| 9 | 397 | 370 | 34 | 341 | 367 | 168 |

The recrystallization rate of the hot rolled strips after hot rolling was 100%. An average grain size in L/ST section between mid-thickness and quarter thickness according to ASTM E-112 intercept method was measured when the coil was cooled down. The results are also presented in Table 4.

The strips were further cold rolled to sheets with a final thickness of 1 mm. The sheets were solution heat treated, such that the equivalent holding time at 540° C. was about 30 s, and quenched in a continuous annealing line.

The surface quality was measured according to VDA Recommendation 239-400 as in example 1.

The roping values RK are presented in Table 5

TABLE 5

| RK values | |
|---|---|
| Ingot | RK |
| 4 | 3.4 |
| 5 | 3.6 |
| 6 | 3.2 |
| 7 | 3.5 |
| 8 | 8.1 |
| 9 | 5.0 |

The surface quality of ingots 4 to 7 according to the invention was much improved compared to ingots 8 and 9.

The 0.2% tensile yield strength, TYS, and ultimate tensile strength, UTS, of the T4 (after 6 days of natural ageing) and bake hardened sheets (2% stretching and 20 min at 185° C.) from those T4 aged sheets were determined in the transverse direction using methods known to one of ordinary skill in the art. The tensile tests were performed according to ISO/DIS 6892-1. The results are provided in Table 6.

TABLE 6

| Mechanical properties | | | |
|---|---|---|---|
| | T4 | | |
| | TYS LT (MPa) | UTS LT (MPa) | Bake hardened TYS LT (MPa) |
| 4 | 100 | 211 | 208 |
| 5 | 93 | 211 | 206 |
| 6 | 105 | 226 | 225 |
| 7 | 99 | 218 | 205 |

TABLE 6-continued

| Mechanical properties | | | |
|---|---|---|---|
| | T4 | | |
| | TYS LT (MPa) | UTS LT (MPa) | Bake hardened TYS LT (MPa) |
| 8 | 102 | 220 | 224 |
| 9 | 98 | 217 | 206 |

Example 3

In this example three ingots made of an alloy having in wt. % the following composition: Si: 0.75; Mg: 0.65; Mn 0.1; Fe<0.16; Ti 0.04; rest aluminium and unavoidable impurities up to 0.05 wt. % each and 0.15 wt. % total were cast into rolling ingots with a thickness of 500 mm and transformed.

The ingots were homogenized and cooled as in example 1.

The ingots were hot rolled with the conditions disclosed in Table 7. The hot rolling mill consisted of a reversing mill and a 4 stands tandem mill, the stands being named C3 to C6, so that rolling in C6 is the last stand of hot rolling.

TABLE 7

| Hot rolling parameters | | | | | |
|---|---|---|---|---|---|
| Ingot | Hot rolling starting temperature [° C.] | Hot rolling exit temperature [° C.] | reduction stand C6 [%] | 1.2*HRST-135 | 1.2*HRST-109 |
| 10 | 402 | 360 | 37 | 347 | 373 |
| 11 | 404 | 369 | 37 | 350 | 376 |
| 12 | 391 | 377 | 39 | 334 | 360 |

The recrystallization rate of the hot rolled strips after hot rolling was 100%.

The strips were further cold rolled to sheets with a final thickness of about 1 mm. The sheets were solution heat treated, such that the equivalent holding time at 540° C. was about 30 s, and quenched in a continuous annealing line.

The surface quality was measured according to VDA Recommendation 239-400 as in example 1.

The roping values RK are presented in Table 8

TABLE 8

| RK values | |
|---|---|
| Ingot | RK |
| 10 | 3.2 |
| 11 | 3.9 |
| 12 | 5.0 |

The surface quality of ingots 10 and 11 according to the invention was much improved compared to ingot 12.

The 0.2% tensile yield strength, TYS, and ultimate tensile strength, UTS, of the T4 (after 6 days of natural ageing) and bake hardened sheets (2% stretching and 20 min at 185° C.) from those T4 aged sheets were determined in the transverse direction using methods known to one of ordinary skill in the art. The tensile tests were performed according to ISO/DIS 6892-1. The results are provided in Table 9.

TABLE 9

| Mechanical properties | | | |
|---|---|---|---|
| | T4 | | |
| | TYS LT (MPa) | UTS LT (MPa) | Bake hardened TYS LT (MPa) |
| 10 | 114 | 223 | 250 |
| 11 | 111 | 221 | 247 |
| 12 | 105 | 212 | 223 |

The invention claimed is:

1. A method for producing a 6xxx series aluminum sheet comprising homogenizing an ingot made from a 6XXX series aluminum alloy, cooling the homogenized ingot with a cooling rate in a range from 150° C./h to 2000° C./h directly to a hot rolling starting temperature HRST, wherein the ingot thickness is at least 250 mm and the ingot is from 1000 to 2000 mm in width and 2000 to 8000 mm in length, the ingot has a top surface, a bottom surface, and four side surfaces, wherein the top and bottom surfaces have a larger surface area than the side surfaces, hot rolling the ingot to a hot rolling final thickness and coiling at the hot rolling final thickness and at a hot rolling exit temperature with such conditions that at least 90% recrystallization is obtained, wherein said HRST is between 350° C. and 450° C. and the hot rolling exit temperature is at least 300° C. and between 1.2*HRST-135° C. and 1.2*HRST-109° C. and/or is set to obtain an average grain size in L/ST section between mid-thickness and quarter thickness according to ASTM E-112 intercept method of less than 160 μm in the longitudinal direction, cold rolling to obtain a cold rolled sheet, wherein the cooling is carried out in at least two phases:

a first spraying phase in which the ingot is cooled in a chamber comprising ramps of nozzles for spraying cooling liquid or spray under pressure, divided into upper and lower parts of said chamber, so as to spray the two large top and bottom surfaces of said ingot, and a second phase of thermal equalization in still air, in a tunnel with interior reflective walls, lasting from 2 to 30 minutes.

2. The method according to claim 1 wherein the thickness reduction during the last stand of hot rolling is at least 25%.

3. The method according to claim 1, wherein the cold rolling reduction is at least 50%.

4. The method according to claim 1 wherein the hot rolling exit temperature is at least 1.2*HRST-123° C. and/or is at most 1.2*HRST-115° C. and/or is set to obtain an average grain size in L/ST section between mid-thickness and quarter thickness according to ASTM E-112 intercept method of less than 150 μm in the longitudinal direction.

5. The method according to claim 1, wherein the hot rolling starting temperature is at least 390° C.

6. The method according to claim 1, wherein the cold rolled sheet is further solution heat treated and quenched in a continuous annealing line.

7. The method according to claim 6 wherein the continuous annealing line is operated in such a way that the equivalent holding time at 540° C., $t_{eq}^{540°}$, is less than 45 sec, the equivalent holding time being calculated according to the equation $$t_{eq}^{540°} = \int_{time\ spent\ in\ furnace} dt \cdot \exp\left[-\frac{Q}{R}\cdot\left(\frac{1}{T^{\circ}\,C\cdot(t)+273} - \frac{1}{540+273}\right)\right]$$

with Q an activation energy of 146 kJ/mol and R=8.314 J/mol.

8. The method according to claim 7, wherein the equivalent holding time at 540° C., $t_{eq}^{540°}$, is less than 35 s.

9. The method according to claim 7, wherein the equivalent holding time at 540° C., $t_{eq}^{540°}$, is less than 25 s.

10. The method according to claim 6 wherein after solution heat treatment and quench the sheet is aged to a T4 temper, cut and formed to a final shape, painted and bake hardened.

11. The method according to claim 1, wherein the ingot thickness is at least 250 mm and wherein a thermal differential of less than 40° C. over the entire ingot cooled from the homogenization temperature is obtained at the hot rolling starting temperature.

12. The method according to claim 1, wherein the alloy comprises Mn 0.03-0.5 wt. % and Cr 0.01-0.4 wt. %.

13. The method according to claim 1, wherein no annealing and/or solution heat treatment after hot rolling or during cold rolling is carried out.

14. The method according to claim 1, wherein the 6XXX series aluminum alloy comprises 0.3-1.5 wt. % of Si, 0.1-1.2 wt. % of Mg and 0.5 wt. % or less of Cu, Mn 0.03-0.5 wt. % and/or Cr 0.01-0.4 wt. %, Fe 0.03 to 0.4 wt. %, Zn up to 0.5 wt. %, V up to 0.2 wt. %, Zr up to 0.2 wt. %, Ti up to 0.1 wt %, rest aluminum and unavoidable impurities up to 0.05 wt. % each and 0.15 wt. % total.

15. The method according to claim 1, wherein said HRST is between 350° C. and 450° C. and the hot rolling exit temperature is at least 300° C. and between 1.2*HRST-135° C. and 1.2*HRST-109° C. and is set to obtain an average grain size in L/ST section between mid-thickness and quarter thickness according to ASTM E-112 intercept method of less than 160 μm in the longitudinal direction.

* * * * *